US009472050B2

(12) United States Patent
Malt

(10) Patent No.: US 9,472,050 B2
(45) Date of Patent: Oct. 18, 2016

(54) COMMUNITY AWARD DISTRIBUTION SYSTEM

(71) Applicant: Bell-Fruit Group Limited, Nottingham (GB)

(72) Inventor: Paul Robert Malt, Nottingham (GB)

(73) Assignee: Bell Fruit Group, Limited, Nottingham (GB)

( * ) Notice: Subject to any disclaimer, the term of this patent is extended or adjusted under 35 U.S.C. 154(b) by 115 days.

(21) Appl. No.: 13/732,907

(22) Filed: Jan. 2, 2013

(65) Prior Publication Data

US 2013/0122991 A1 May 16, 2013

Related U.S. Application Data

(63) Continuation-in-part of application No. 13/191,561, filed on Jul. 27, 2011.

(30) Foreign Application Priority Data

Jul. 27, 2010 (GB) ..... 1012573.0
Jun. 28, 2012 (CA) ..... 2781190

(51) Int. Cl.
*A63F 9/00* (2006.01)
*G07F 17/32* (2006.01)

(52) U.S. Cl.
CPC ..... *G07F 17/3244* (2013.01); *G07F 17/329* (2013.01); *G07F 17/3288* (2013.01)

(58) Field of Classification Search
USPC ..... 463/20
See application file for complete search history.

(56) References Cited

U.S. PATENT DOCUMENTS

| | | | | |
|---|---|---|---|---|
| 2006/0009283 | A1* | 1/2006 | Englman et al. | 463/29 |
| 2006/0046821 | A1* | 3/2006 | Kaminkow et al. | 463/16 |
| 2006/0073897 | A1* | 4/2006 | Englman et al. | 463/42 |
| 2007/0060320 | A1 | 3/2007 | Kelly et al. | |
| 2007/0184896 | A1 | 8/2007 | Dickerson | |
| 2009/0275410 | A1* | 11/2009 | Kisenwether et al. | 463/42 |
| 2010/0120494 | A1 | 5/2010 | DeWaal et al. | |
| 2011/0034241 | A1 | 2/2011 | Englman et al. | |
| 2012/0034968 | A1* | 2/2012 | Watkins et al. | 463/20 |

FOREIGN PATENT DOCUMENTS

| | | | |
|---|---|---|---|
| GB | 2405736 | A | 3/2005 |
| WO | 2007030552 | A2 | 3/2007 |
| WO | 2009061386 | A1 | 5/2009 |

* cited by examiner

*Primary Examiner* — Seng H Lim
(74) *Attorney, Agent, or Firm* — Kevin H. Fortin

(57) ABSTRACT

Disclosed are community award distribution systems and related methods, which are arranged to control an award made to a use playing the systems. Also disclosed, the community award systems are arranged to communicate over the Internet and/or make use of the World Wide Web.

19 Claims, 5 Drawing Sheets

COMMUNITY AWARD DISTRIBUTION SYSTEM

CROSS-REFERENCE TO RELATED APPLICATIONS

This application claims the benefit of U.S. patent application Ser. No. 13/191,561, titled "COMMUNITY AWARD DISTRIBUTION SYSTEM" and filed Jul. 27, 2011, which claims the benefit of UK Patent Application Serial No. 1012573.0, filed on Jul. 27, 2010. This application also claims the benefit of Canadian Patent Application Serial No. 2,781,190, filed on Jun. 26, 2012. The foregoing applications are hereby incorporated by reference in their entireties.

FIELD OF INVENTION

This invention relates to a community award distribution system and related methods. In particular, the invention may relate to a community gaming system which is arranged to control an award made to the or each user playing the system and related methods. In particular, but not exclusively, the community award system is arranged to communicate over the Internet and/or make use of the World Wide Web.

BACKGROUND OF INVENTION

It is known to provide award distribution systems which users can access across network connections, which are typically Internet based, and have awards paid out therefrom dependent upon the users performance. Often such award distribution systems are referred to as community systems.

Traditional non-network award terminals provide complex schemes to determine whether or not an award should be made to a user. As a starting point, a skilled person would assume that to provide a networked game would simply require re-creating the functionality of a non-networked award terminal across a network. However, to support the functionality of such a non-networked award terminal would impart a severe burden on the network requiring significant communication between a networked terminal and a server (s) monitoring and/or controlling awards being distributed by the networked system. As such, significant technical issues are placed upon the networked infrastructure.

Moreover, such community award distribution systems may be played by many players and could be played by 10's, 100's, 1000's, 10,000's, 100,000's or even more players. Accordingly, as the number of users of the award system increases then mechanisms need to be employed to ensure that users of the system cannot trigger distribution of an award too frequently.

SUMMARY OF INVENTION

According to a first aspect of the invention there is provided a community award distribution system. The system may comprise at least one server arranged to communicate over a network with a community of terminals and provide an award scheme. The award scheme may pay an award to be distributed between users of the community of terminals and the server may be arranged to monitor the number of users using the community of terminals and control the award scheme. In one embodiment, the server may control the terminals so that they provide an award to the users at, on average, a fixed and predetermined time period. In other embodiments, the system may be arranged to provide the award on a randomly occurring basis, where the long term resultant average time between such awards is a predetermined time period.

An advantage of such a system is that it that it significantly reduces the amount of network traffic that is needed to run the award system. The server(s) do not need to continuously monitor the community of terminals and as such the need for extensive network communication is removed.

The skilled person will appreciate that the server conveniently comprises a timer arranged to monitor time and ensure that on average an award is made to the users of the community at the fixed and predetermined time period.

Conveniently, the system is arranged such that the number of users does not affect the fixed predetermined time.

In one embodiment, the server is arranged to provide an award determining mechanism which is used to determine whether an award should be made. In one embodiment, the award determining mechanism comprises set of reels (which may be physical and/or a simulation thereof).

In other embodiments the award determining mechanism may comprise other mechanisms such as roulette wheels, dice, a deck of cards or the like.

In one particular embodiment, the server comprises a plurality of award determining mechanisms. Further, the server may be arranged to switch between award determining mechanisms in order to control whether or not an award should be made to the community of users; i.e. whether or not to provide a community feature game. For example, the plurality of award determining mechanisms may comprise a plurality of sets of reels each of which contains a distinct set of symbols thereon.

Potential advantages of embodiments of the system may be as follows:

- The number of users (i.e. community members) of the system is scalable from 1 user to an unlimited number of users.
- The Return To Player (RTP) of an individual users basic/community is not adversely affected by other users entering or exiting the community, or other user's speed of play, or other user's level of wagering etc.
- Community feature is triggered as a chance event reel combination from an eligible user.
- Community feature frequency is unaffected by the number of users in the community, and their speed of play.
- The theoretical frequency of the community feature is on average a fixed period. In one embodiment, the fixed predetermined period is roughly every 800.95 seconds. However, other embodiments may used other fixed predetermined periods. For example, the fixed predetermined period may be roughly any of the following: 50, 100, 200, 300, 400, 500, 600, 700, 900, 1000, or more seconds. This is a random event so is subject to wide variation. However, the skilled person will appreciate that over a period the average will approach this fixed and predetermined time.
- The global award multiplier from the community feature is entirely random with no adaptive behaviour. Therefore, the game does not maintain a pot for user contributions from total bet.
- The system employs no adaptive behaviour based upon previous outcomes so ensuring the games legal compliance in various jurisdictions.

In some embodiments, the system is arranged such that each terminal within the community of terminals is arranged to provide a display presenting the award scheme provided by the server. The award scheme is typically arranged to be played by a user from time to time in a relatively short period. Wherein in this context, relatively short is on the order of seconds and is perhaps roughly any of the following: 1, 2, 3, 4, 5, 6, 7, 8, 9, 10, 15, 20 or 30 seconds.

Each terminal may be arranged to maintain an eligibility time which is incremented each time a user plays a new game and is subsequently decremented with the passage of time. As such, an incentive is provided to a user to keep playing the award scheme in so far as that if the period between his/her plays is slower than the amount of time given to him/her when they play a new game then his/her eligibility timer will not increase. A pointer may be provided which indicates the value of a user's eligibility timer.

The user's eligibility timer may be used as a multiplier to help determine an award made to a user.

Each terminal may be arranged, when a user plays a new game, to send a data packet to the server. Such data packet may contain a time stamp indicating when the start of that game occurred.

In response to the data packet sent from the terminal the server may return a reply data packet containing at least one of the following, and in some embodiments all of the following: the position to which the award determining mechanism should be moved; the result of that game; the status of the credit of the user; and the value of the eligibility timer for that user. In such an embodiment, it will be seen that the game is provided by the server and the terminal is used to display the outcome to the user.

The eligibility time may be used to determine whether a user is eligible to participate in a community feature game, any award from which is distributed amongst any user of an eligible terminal. The server may be arranged to send at least one data packet to eligible terminals within the community when a community game is started.

In other embodiments, the server may be arranged to trigger a community feature game as part of reply data packet, to the player request packet. As such, the server is arranged to only respond to requests from a client, rather than the server starting a communication with a client.

The terminal may also be arranged to interrogate the server from time to time, which may be periodically (i.e. 6 seconds) to check if a community feature is pending. This interrogation of the server may only occur following inactivity from the user, after 6 seconds.

A community game may be started by a predetermined occurrence on the award determining mechanism. It will be appreciated that the server may control whether or not a community feature game is provided by utilising which award determining mechanism is used.

It will be appreciated that despite the community nature of the award scheme (i.e. that an award can be shared between a plurality of users) there is no need to have extensive communications across the network between each of the users of the community. The use of the timer and/or plurality of award determining mechanisms which can be selected provides technical means which solve the problem of having extensive network communication to ensure that the community award scheme is synchronised.

Conveniently, the community of terminals comprises a plurality of terminals, but the skilled person will appreciate that the community can include a single terminal.

According to a second aspect of the invention there is provided a method of providing a community award comprising providing a server which communicates over a network with a community of terminals and provides an award scheme thereto such that the award scheme is distributed between users of the community of terminals, wherein the server monitors the number of users using the community of terminals and controls the award scheme to that it provides an award to the users at, on average, a fixed and predetermined time period.

According to a third aspect of the invention there is provided a server comprising a timer and a plurality of award determining mechanisms and being arranged to communicate with a plurality of terminals, in use, the server being arranged to provide an award to be shard between users of the terminals at, on average, a fixed predetermined time, the server being arranged to receive a communication from any one of the terminals indicating that a game has been started on that terminal and to respond with a reply data packet indicating the outcome of that game.

Typically, the server is arranged to control the award determining mechanism in order that an award is paid to the community of users at, on average, the predetermined fixed period.

Typically the period is provided on a random basis and as such there may be variation between the times at which the server determines an award should be shared between the community of users.

According to a further aspect of the invention there is provided a community award distribution system comprising at least one server arranged to communicate over a network with a community of terminals and provide an award scheme to be distributed between users of the community of terminals.

According to a further aspect of the invention there is provided a community award distribution system. The system may be arranged to distribute an award between a plurality of users, wherein the system conveniently comprises at least one of the following features a to e:

a) at least one server and a plurality of terminals arranged to be in communication with the at least one server across a network connection between the server and each terminal;

b) wherein the server is arranged to provide an award scheme that is arranged to distribute an award between at least some of the terminals in communication therewith, wherein the award has been contributed to by at least some of the terminals and wherein each of the terminals is arranged to provide a trigger mechanism to determine when the award scheme is triggered; and c) wherein the system is arranged such that the terminals are arranged to provide users thereof with the trigger mechanism and generate a communication between the server/terminal across the network connection when the trigger mechanism determines the award scheme should be initiated;

d) the trigger mechanism being arranged such that it provides a delay such that it typically takes more than a predetermined amount of time to trigger the award scheme; and e) the server then being arranged to execute the award scheme and distribute the award between the at least some terminals and communicate the award to those terminals across the network connection.

According to a further aspect of the invention there is provided a server arranged to be connected to a plurality of terminals and provide a community award distribution system which distributes an award which has been contributed to by at least some of a plurality of terminals connected thereto, wherein the server is arranged to perform at least one of the following steps:

a) receive a request from a terminal that the terminal should connect to the server for the provision of the community award distribution system;

b) download data to the terminal wishing to connect to the server for the provision of the community award distribution system, the data providing a trigger mechanism which includes a delay such that it typically takes more than a predetermined amount of time to trigger the distribution of an award;

c) receive data from a terminal indicating inputs made to the trigger mechanism;

d) determine whether the data indicating the inputs made to the trigger mechanism provide a trigger point;

e) once a trigger point has been detected determine whether an award scheme should be started;

f) determine the completion of the award scheme and subsequently determine the award to be made to one or more terminals connected thereto; and g) communicate the award to any terminal that has received an award.

The trigger mechanism is typically arranged to allow a user to interact with a terminal that he/she is using. In some embodiments, the trigger mechanism provides a game that a user can play. The trigger mechanism may be a reel based game and will typically be provided by virtual reels on what may be termed a video display.

In other embodiments, the trigger mechanism may be provided by a trail based game in which a user progresses around a trail. Typically a user will progress around the trail according to an event, which may be a random event, which determines progress around the trail.

Some embodiments may be arranged such that the trigger mechanism includes a delay which is started once the trigger point has been detected. The delay may be provided by a timer or the like.

In other embodiments, the trigger mechanism may be arranged such there is an inherent delay before a user is able to reach a trigger point (and thereby an inherent delay before the server is able to detect the trigger point). For example, it may take a user time to move around a trail and reach a trigger point within the trail (which may for example be the end of the trail).

According to a further aspect of the invention there is provided a server arranged to be connected to a plurality of terminals and provide a community award distribution system which is arranged to distribute, between at least some of the terminals connected thereto, an award which has been contributed to by at least some of a plurality of terminals connected thereto, wherein the server is arranged to:

In some embodiments of the invention the server is arranged to distribute the community award to set of terminals which is different to the set of terminals that contributed to the award. In other embodiments the two sets may be the same.

In the above aspects reference is made to an award scheme. Such an award scheme may be provided by what is commonly termed a game and as such the phrase award scheme may be replaced with the phrase game.

There may be provided a machine readable medium containing instructions which when read by a machine cause that machine to perform the method of, or function as the hardware of any of the above aspects of the invention.

In any of the above aspects of the invention the machine readable medium may comprise any of the following: a floppy disk, a CD ROM, a DVD ROM/RAM (including a −R/−RW and +R/+RW), a hard drive, a memory (including a USB memory key, an SD card, a Memorystick™, a compact flash card, or the like), a tape, any other form of magneto optical storage, a transmitted signal (including an Internet download, an FTP transfer, etc), a wire, or any other suitable medium.

Further, the skilled person will appreciate that a feature of any one of the above aspects of the invention may be applied, mutatis mutandis, to any of the other features of the invention.

BRIEF DESCRIPTION OF DRAWINGS

There now follows by way of example only a detailed description of an embodiment of the present invention with reference to the accompanying drawings in which.

DETAILED DESCRIPTION OF DRAWINGS

The community award distribution system (CADS) 100 comprises a network 102, which in this embodiment is provided by the Internet and World Wide Web (WWW). However, other embodiments may use other networks.

The network may comprise wired and/or wireless connections which may be provided by a variety of carriers.

The CADS 100 comprises a server 104 which monitors a number of terminals 106-116 (which may be thought of as a community of terminals) to provide a community award scheme to the users of the those terminals. The figures shows that the terminals may be any number of devices capable of communicating across the network 102 with the server 104 and the Figure exemplifies a mobile telephone 106 and a Personal Computer 116, such as a MAC™, a PC or the like. However, the terminals 104-114 may be any other suitable form of device such as a PDA (Personal Digital Assistant), a Television, a games console (such as a Playstation™, XBox™, etc.), an iPad™, etc. Indeed, it will be seen that FIG. 1 shows generic screens for terminals 108, 110, 112, 114 which may be any such device.

Figure 1:
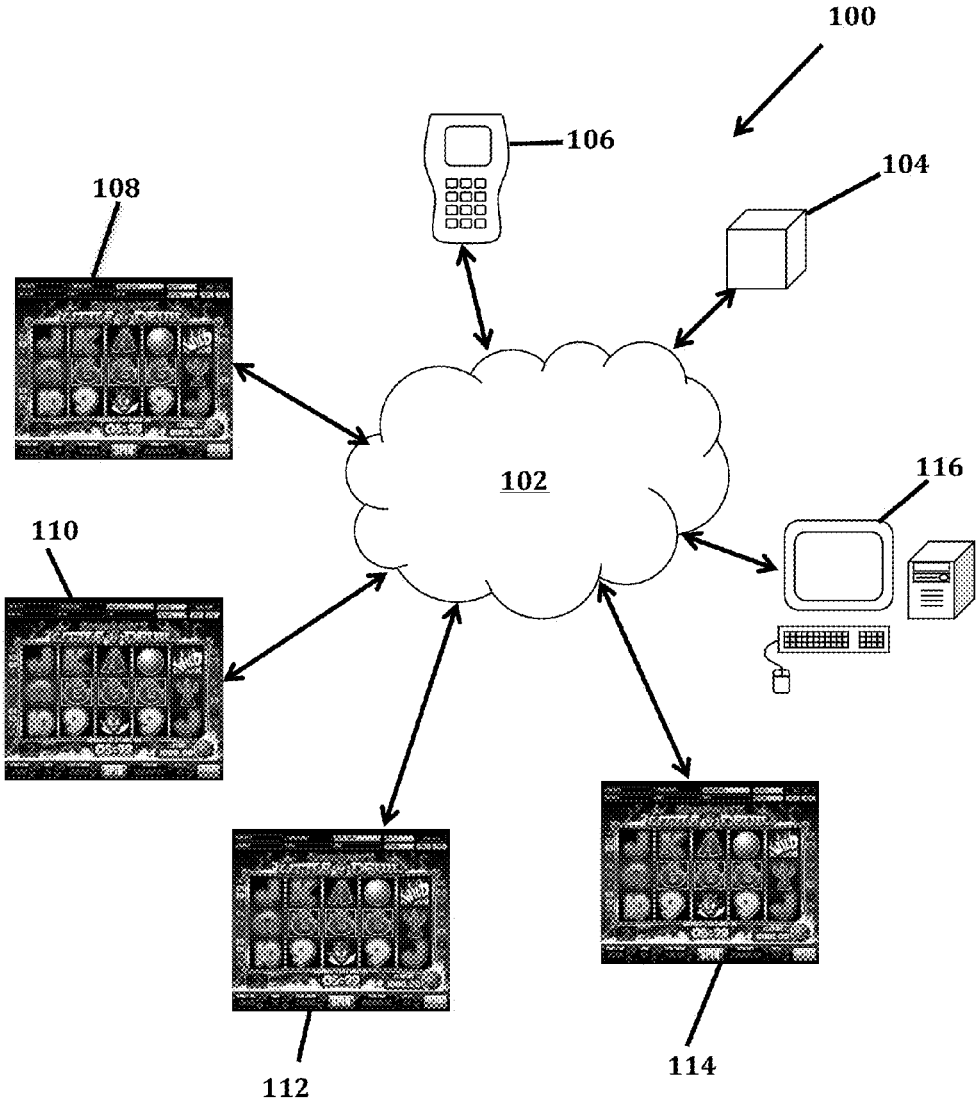
FIG. 1 exemplifies a network providing an embodiment of a community award distribution system.

The generic screens on the terminals shown in FIG. 1 provide, in the embodiment being described, a game that a user of the terminal can play. This game provides a trigger mechanism which is used to trigger an award scheme which when triggered distributes an award between at least some of the users of the terminals as described hereinafter. In other embodiments, it is conceivable that the trigger mechanism may be provided by something other than a game.

In one embodiment, the server 200, comprises a display 204, processing circuitry 206, a keyboard 208, and mouse 210. The processing circuitry 206 further comprises a processing unit 212, a hard drive 214, a video driver 216, memory 218 (RAM and ROM) and an I/O subsystem 220 which all communicate with one another, as is known in the art, via a system bus 222. The processing unit 212 comprises an INTEL PENTIUM series processor. The terminals 106-116 may have similar components, mutatis mutandis, to those shown as the server in FIG. 2. In other embodiments, the processing unit may be other than a Pentium Series processor and may be an AMD® an i5 or i7 processor or the like.

As is known in the art the ROM portion of the memory 218 contains the Basic Input Output System (BIOS) that controls basic hardware functionality. The RAM portion of memory 218 is a volatile memory used to hold instructions that are being executed, such as program code, etc.

The hard drive 214 is used as mass storage for programs and other data and would typically be provided as a Redundant Array of Inexpensive Discs (RAID).

Other devices such as CDROMS, DVD ROMS, network cards, etc. could be coupled to the system bus 222 and allow for storage of data, communication with other computers over a network, etc.

The server 200 could have the architecture known as a PC, originally based on the IBM specification, but could equally have other architectures. The server may be an APPLE, or may be a RISC system, and may run a variety of operating systems (perhaps HP-UX, LINUX, UNIX, MICROSOFT NT, AIX™, OSX, Apache or the like).

Figure 3:
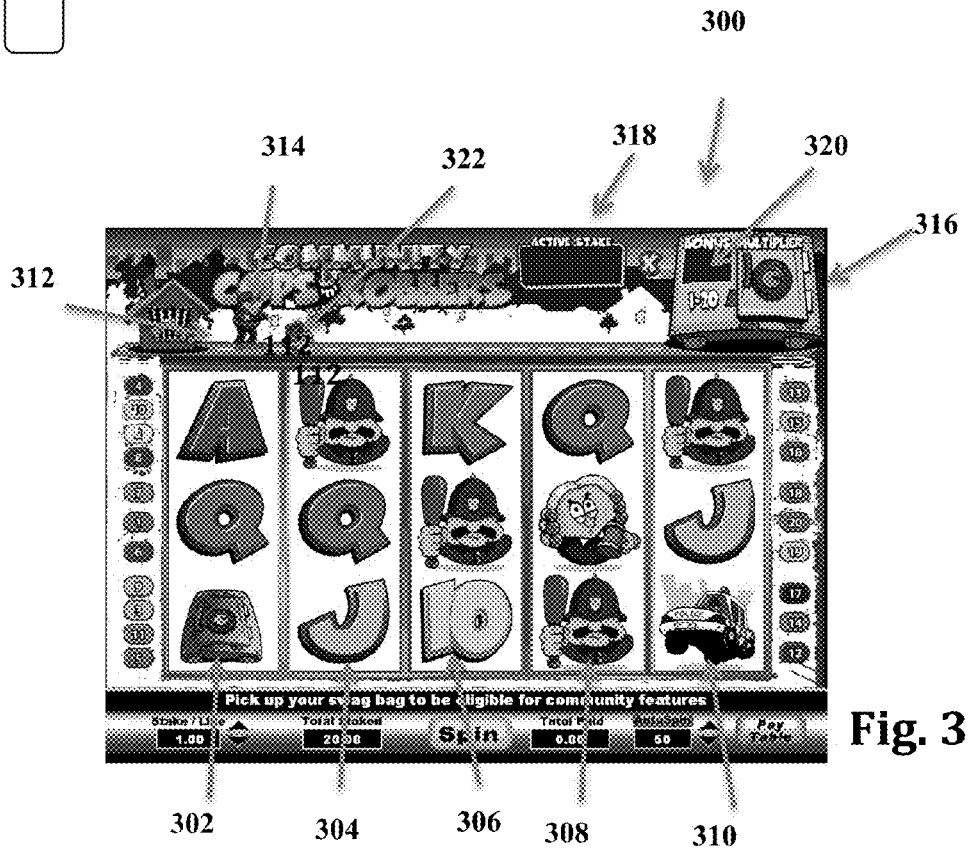
FIG. 3 shows an example screen shot from an embodiment of the idea.

FIG. 3 shows an enlargement 300 of the screen shots on the terminals 108, 110, 112, 114 shown in FIG. 1 and comprises five reels 302, 304, 306, 308, 310 together with a community award eligibility display region CAEDR (312) along a top region of the screen shot 300. The reels may be thought of as an award determining mechanism used by the server 104 to determine whether an award should be made to a user and/or the community of users. Such an award determining mechanism may be thought of as a way to provide a delay.

When a user wishes to participate in the community award distribution system he/she uses his/her terminal (e.g. 106-116) to contact the server 104. The skilled person will appreciate that there may well be a plurality of servers which communicate with the network 102 and a user may communicate with any of these or indeed more than one server. The system rather than the user may determine with which server 104 the user's terminal communicates.

When the user's terminal 106-116 contacts the server 104 the server responds by downloading content onto the terminal sufficient for that terminal to provide the display to the user thereof (e.g. the screenshot 300 shown in FIG. 3). In the embodiment being described the community award distribution system is provided by FLASH™ but may, in other embodiments, be provided by other technology such as HTML (Hyper Text Markup Language) version 5.

In the embodiment being described, the server 104 and the terminals 106-116 operate in, what the skilled person may term, a thin client mode. That is the server 106 performs the processing that the terminal 106-116 simply displays the outcome of that processing. Other embodiments may be arranged such the terminals 106-116 operate in, what the skilled person may term, a fat client mode in which the terminals perform the processing and communicate the outcome of that processing to the server 104.

However, the Community Award Distribution System downloaded to the terminal (e.g. 106-116) thereafter provides the system to a user thereof and is arranged to reduce the amount of ongoing communication between the terminal 106-116 and the server 104.

Being a community game, the server 104 is arranged to provide an award to each user which is using the CADS 100 when the server 104 determines that an award should be made. As such, despite trying to reduce network ongoing network communication the server 104 is also arranged to control the CADS 104 in order that the award paid to the community does not become excessive despite being provided in a random environment; if the awards become too large then the provider of the CADS 100 may not be able to fulfil that award.

In the embodiment being described, the community award distribution system may be used by an unlimited number of users of the terminals. Conveniently, the system 100 is arranged such that the return to the player (RTP) is unaffected by the number of users.

To this end the CAEDR (312) at the top region of the display 300 is used to display whether a user is eligible for a community award.

The CAEDR (312) in the CADS 100 is depicted above as a Cop chasing a Robber 314 along a top region of the screen 300. The maximum eligible time (ATA_CAP_MAX) is 66 seconds and is represented by the Robber 314 advancing to the far right of the screen 300 adjacent what is depicted in this embodiment as a safe 316. The Cop is always to the far left of the screen and so appears to be running on the spot.

In the embodiment being described when a user makes an input to the CADS 100 (i.e. plays another game), the position of the Robber 314 advances forward (very quickly) 6 seconds with the start of a game played. As such, the CAEDR 312 provides a timeline along which a pointer (i.e. the Robber 314) is moved. However, the position of the Robber is also continuously moving backwards by a distance of 1 second, for every 1 second elapsed. Therefore, if the user is playing at a rate of 1 game every 6 seconds, the Robber will appear to move only slightly forwards and backwards about the same position. If played at a faster rate of 4 seconds per game the Robber will move forward 6 seconds and drop back 4 seconds, and so steadily advance forward at an average rate of 2 seconds per game. If the speed of play slows to greater than 6 seconds per game the Robber will approach the left side of the screen and will ultimately be caught up by the Cop.

In the embodiment being described, when a user plays another game on his/her terminal a data packet is sent to the server 104. This data packet is time stamped in order that the server 104 identifies the time at which the game was started. The terminal 106-116 also sends to the server 104 any one or more of the following: the stake, the stake per line and the selected win lines.

The terminal also had recorded thereon, a cookie which is used to identify that terminal 106-116 to the server 104.

In response, the server 104 returns a reply data packet to the terminal that sent the request (which of course may be a plurality of data packets). The reply data packet contains the results of that game which the Flash™ client on the terminal then displays. The server reply contains the reel positions to which the reels 302-310 should be moved, whether or not the game has resulted in a win, the status of that user's credit (i.e. account balance) and confirmation of the value of the Eligibility Timer (ET)—which is reflected by the position of the robber 314—which is subsequently synchronised with a local timer on the terminal 106-116.

Figure 4A:
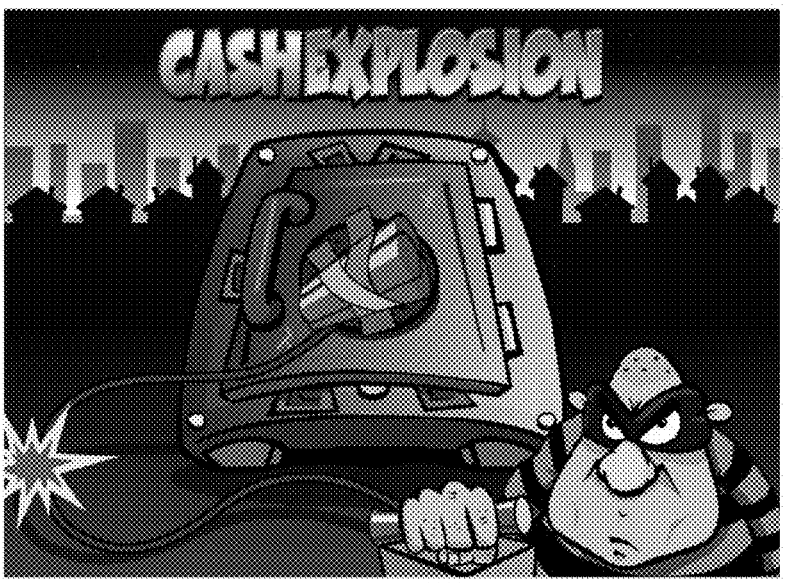
FIG. 4*a* shows a first screen from an example of a community feature game that may be provided by embodiments.
Figure 4B:
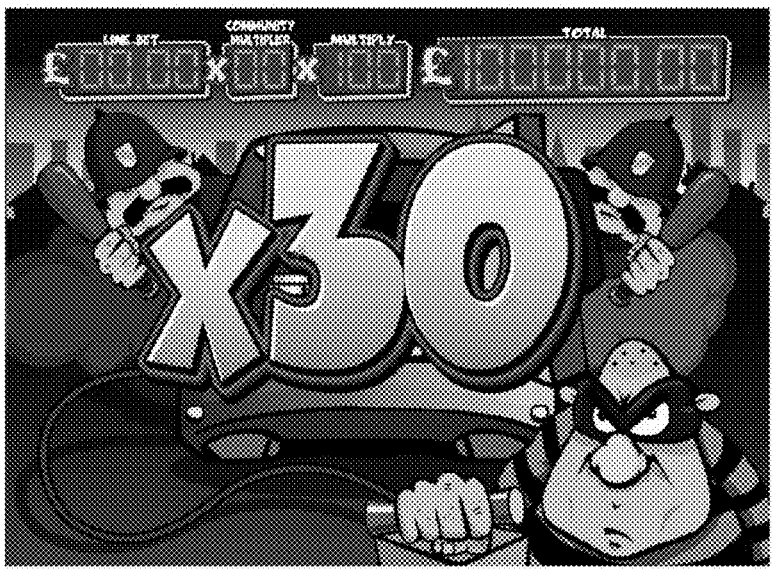
FIG. 4*b* shows a second screen from an example of a community feature game that may be provided by embodiments.

Also, the reply data packet contains details of whether a community game feature has been triggered (as exemplified in FIGS. 4*a* and 4*b*).

Should a player be eligible to play a community feature game (i.e. his/her ET>6) then he/she is also sent a string of states-per-second) so that the terminal may move the user to the correct stake after using up his/her earned time.

In such circumstances, the server 104 about a community queue which contains information about the community feature game for which that user is eligible.

This data also contains information such as the feature level (3, 4 or 5 symbols in view), the stake and multiplier values that were being used by the player when this feature was triggered, and the timestamp of exactly when the feature was triggered. The timestamp matches the one sent to all players who were eligible for this particular feature. It is then used to seed a random number generator which ensures all players will see the same in-feature results by picking the same random numbers as every other player.

When users become eligible for the community feature, his/her stake value is recorded for each second of eligibility they now possess. This string of stakes-per-second is sent to the game so that the game can move the player to the right stake value after using up their earned seconds.

The top region of the screen 300 also comprises an ACTIVE STAKE meter 318, which is also referred to in this document as Community Stake (CS), which is the bet per line, with reference to Eligibility Time which is maintained by the terminal 106-116 being used by a user. However, in the embodiment being described, it is noted that the server 104 additionally maintains a master copy of the timer, that being maintained by the terminal 106-116 being a local copy. The local copy is synchronised with the timer on the server 104 using the reply data packet sent from the server 104 to the terminal 106-116. At least one advantage of the local timer is that it allows the CAEDR 312 to be maintained irrespective of whether a user is staring new games on the terminal 106-116. This synchronisation from time to time (as opposed to continuous communication) also helps to reduce network traffic.

The Bonus Multiplier 320 (BM) (displayed as a portion of the safe 316) increases from ×1 to ×20 in a linear proportion to the Eligibility Timer over the range 1 to 60 seconds. The Bonus Multiplier 320 further increases from ×20 to ×45 in response to the Eligibility Timer being capped at a maximum of 66 seconds. The Additional Time Added (ATA) to the Eligibility Timer for each game played is typically 6 seconds. However, due to the Eligibility Timer being capped at a maximum of 66 seconds, ATA can drop to 3 seconds, which is reflected by a higher BM 320. The capping of the Eligibility Timer is graduated from 61 to 66 seconds with progressively more seconds being capped, and a progressively higher average BM 320 to maintain a constant percentage theoretical Return To Player. This graduation to the capping of Eligibility Timer is done to provide a more graduated change in the BM, for aesthetic reasons.

On CADS 100 the eligibility to the community feature is depicted graphically as a swag-bag 322 (to the left of the screen 300) which is part of the CAEDR (312), where the Robber 314 advances to just past the 6 second position where he picks up the swag-bag 322 (signifying his eligibility to the community award). The Robber 314 keeps hold of the swag-bag 322 until caught by the Cop, whereupon the swag-bag 322 is dropped and returned to the 6 second position. The Robber must then again advance to just past the 6 second position to pick-up the swag-bag 322 to be eligible again.

Imagine the Eligibility Timer is a decimal register that is incremented by 6 seconds, at the beginning of each game, and is repeatedly decremented by 1 second at an interval of every 1 second. The user becomes eligible for the community award when the Eligibility Timer is greater than 6 (Eligibility Timer>6). The user remains eligible until Eligibility Timer runs back down to zero. An Eligibility Flag (EF) is used to reflect whether or not a user is eligible for a community award; where the flag is set when Eligibility Timer>6, and the flag is cleared when Eligibility Timer=0.

For example:

1. When the user first logs (the server 104 downloads to the terminal 106-116) in the Eligibility Timer=0.
2. When the first game is played Eligibility Timer is incremented by 6, so Eligibility Timer is now equal to 6.
3. Eligibility Timer is not greater than 6, so at this stage the eligibility flag is not set.
4. When the second game is played Eligibility Timer is again incremented by 6, so if Eligibility Timer was previously greater than zero, it will now be greater than 6, and so the eligibility flag is now set.
5. The eligibility flag remains set until Eligibility Timer runs down to zero, upon where the eligibility flag would then be cleared.

The net result of this process is to limit the average minimum speed of play to less than 6 seconds per game, while remaining eligible for the community feature.

The main advantage of limiting the eligible minimum average speed of play to 6 seconds per game is that it prevents the BM from dropping below ×1 which would require fractional/decimal representation which would tend to increase the computational load to calculate the bonus. Such fraction/decimals would also produce an award of below the minimum unit denomination that would be harder to return to a user or awkward to store for later aggregation with other similar less than unit denomination awards. These problems are particularly the case when the award is a currency award rather than, for example, points.

The community feature is activated randomly by an eligible user in the community (i.e. a user which has managed to set the eligibility flag EF on his/her terminal) achieving a predetermined feature reel combination. Which for example may be 3, 4, 5 or more symbols in view upon the reels. An Ineligible user which has not set his/her eligibility flag (EF) cannot trigger the community feature.

The community feature is then played out automatically for all users in the community (i.e. each user with a set eligibility flag). The multiplier award from the community feature will be the same feature for all users in the community. Although, it's also envisaged that the alternative of giving users a non-common award multiplier which is determined for each user individually, on the same random basis, has advantages of preventing the statistical variation in the return to player percentage increasing with the number of eligible users in the community.

The eligibility countdown will remain active throughout the community feature, although this is unlikely to be visible on the feature screen; i.e. whilst the eligibility timer is decremented there is no display to a user. If the Eligibility Timer expires during the community feature, the user will still be awarded the win from the community feature. However, they would not be eligible for additional community features that may have been activated at the moment the timer expired. For example, it is conceivable that non-eligible could become eligible during a community feature and trigger a subsequent community feature which would then be played by all eligible users when the current community feature has finished.

Conversely, if the Eligibility Timer had not expired at the moment when another community feature is activated, the user would be eligible for an additional feature, which would be held in an individual user queue. Any queued community features will also need to store the associated community multiplier award CMA, and the instantaneous BM and Community Stake CS (from the Eligibility Timer stored information buffer) at the moment the community feature was triggered. The recorded CMA, BM, and CS in the queue will be used when determining the resultant award from each community feature in the queue, as follows:

Community award=CMA×CS×BM

The Community award may be paid in any suitable currency. For example, the community award may be paid in cash (perhaps to an account of the user), credits to be used at a later time, points, or the like.

Any community features held in the queue will be immediately delivered following the current feature, and so on. Hence, the user can not start a new game until the feature queue is emptied. If a community feature occurs before the user initiates the start of a new game, the community feature must be executed first, so preventing users from staking up (i.e. raising the stake at which they are playing) at the instant the community feature occurs.

Alternative embodiments may halt the eligibility counter counting down (i.e. freeze) for the duration of the community feature.

Additional information is stored with reference to the Eligibility Timer. This information includes the Community Stake (CS) and Bonus Multiplier (BM).

The purpose for storing this information is to enable the game to maintain a constant Return to Player even if the user dynamically changes his/her total bet. An example, scenario could have existed where the user would build up their Eligibility Timer while only committing minimum stake. Then once his/her Eligibility Timer is full they would play 1 more game at a higher stake and then wait while the Eligibility Timer descends in the hope that somebody else triggers the community feature in the time it take the Eligibility Timer to expire, resulting in a much higher payout based upon their last much higher stake amount. As such, the following strategy is employed to mitigate against such tactics on the part of the user.

The Community Stake (CS) display shows the user their current instantaneous stake within the community, which could be different to his/her ordinary stake, dependant upon their previous stake history. The amount displayed in the CS meter is not determined as an average of the previous stake history, but instead is displayed as the actual amount previous staked per line, with reference to the Eligibility Timer (see example below).

| ET | GTA | stake/line | CS buffer | CS | BM | BM buffer | Action |
|---|---|---|---|---|---|---|---|
| 0 | | | | 0 | | | |
| (0 + 6) = 6 | 6 | 1p | 1, 1, 1, 1, 1, (1) | 1p | 2 | 1, 1, 1, 2, 2, (2) | game 1 |
| 5 | | | 1, 1, 1, 1, (1) | 1p | 2 | 1, 1, 1, 2, (2) | |
| 4 | | | 1, 1, 1, (1) | 1p | 2 | 1, 1, 1, (2) | |
| (3 + 6) = 9 | 6 | 2p | 1, 1, 1, 2, 2, 2, 2, 2, (2) | 2p | 3 | 1, 1, 1, 2, 2, 2, 3, 3, (3) | game 2 |
| 8 | | | 1, 1, 1, 2, 2, 2, 2, (2) | 2p | 3 | 1, 1, 1, 2, 2, 2, 3, (3) | |
| 7 | | | 1, 1, 1, 2, 2, 2, (2) | 2p | 3 | 1, 1, 1, 2, 2, 2, (3) | |
| 6 | | | 1, 1, 1, 2, 2, (2) | 2p | 2 | 1, 1, 1, 2, 2, (2) | |
| (5 + 6) = 11 | 6 | 5p | 1, 1, 1, 2, 2, 5, 5, 5, 5, 5, (5) | 5p | 4 | 1, 1, 1, 2, 2, 2, 3, 3, 3, 4, (4) | game 3 |
| 10 | | | 1, 1, 1, 2, 2, 5, 5, 5, 5, (5) | 5p | 4 | 1, 1, 1, 2, 2, 2, 3, 3, 3, (4) | |
| 9 | | | 1, 1, 1, 2, 2, 5, 5, 5, (5) | 5p | 3 | 1, 1, 1, 2, 2, 2, 3, 3, (3) | |
| 8 | | | 1, 1, 1, 2, 2, 5, 5, (5) | 5p | 3 | 1, 1, 1, 2, 2, 2, 3, (3) | |
| 7 | | | 1, 1, 1, 2, 2, 5, (5) | 5p | 3 | 1, 1, 1, 2, 2, 2, (3) | |
| 6 | | | 1, 1, 1, 2, 2, (5) | 5p | 2 | 1, 1, 1, 2, 2, (2) | |
| 5 | | | 1, 1, 1, 2, (2) | 2p | 2 | 1, 1, 1, 2, (2) | |
| 4 | | | 1, 1, 1, (2) | 2p | 2 | 1, 1, 1, (2) | |
| 3 | | | 1, 1, (1) | 1p | 1 | 1, 1, (1) | |
| 2 | | | 1, (1) | 1p | 1 | 1, (1) | |
| 1 | | | (1) | 1p | 1 | (1) | |
| 0 | | | | 0 | 1 | | |

For every new game the CS buffer is updated with the current stake between the positions of the old and new Eligibility Timer. Following every second lapsed by the Eligibility Timer, the CS display is updated with the stake information retrieved from the CS buffer. The leftmost column in the above table shows the contents of the Eligibility Timer; i.e. the time elapsed in the game. The same procedure is also adopted for the BM display, where the BM buffer is updated with the current BM between the positions of the old and new Eligibility Timer. Following every second of time that the Eligibility Timer counts down the BM display is updated with the information retrieved from the BM buffer.

In the example above the GTA (Game Time Average) is always 6 seconds (ATA—Additional Time Added), despite the variation in speed of play. This defines GTA=ATA, except when the Eligibility Timer is being capped. Therefore, if a game is played when Eligibility Timer=56 seconds, Eligibility Timer will increase by ATA (6 seconds) to give 62 seconds. However, Eligibility Timer is capped at 61 seconds when Eligibility Timer is 56. Therefore, 1 second on the Eligibility Timer must be removed. This loss of 1 seconds on the Eligibility Timer is accounted for by calculating GTA=ATA−1=5.

GTA=ATA−(time capped from ET when ET exceeds dynamic_ATA_CAP[ET])

static const int dynamic_ATA_CAP[ATA_CAP_MAX+1] ={60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 61, 62, 63, 63, 64, 65, 66, 66, 66, 66, 66};

When the ET is not being capped BM=progressive_bm [ET]

static const int progressive_bm[ATA_CAP_MAX+1]={1, 1, 1, 1, 2, 2, 2, 3, 3, 3, 4, 4, 4, 5, 5, 5, 6, 6, 6, 7, 7, 7, 8, 8, 8, 9, 9, 9, 10, 10, 10, 11, 11, 11, 12, 12, 12, 13, 13, 13, 14, 14, 14, 15, 15, 15, 16, 16, 16, 17, 17, 17, 18, 18, 18, 19, 19, 19, 20, 20, 20, 20, 20, 20, 20, 20, 20};

When the Eligibility Timer is being capped (as determined by the new GTA) the amount of capped time (1, 2, 3 seconds, etc) is used to index the following structured array to access the min and max random range for the BM.

```
static const struct
{
    int min_bm;
    int max_bm;
} random_bm[ATA-MIN_GTA]=
{
    { 23, 25 },   // used when 1 second deducted off ATA, averages at
24
    { 26, 34 }, // used when 2 seconds deducted off ATA, averages at 30
    { 35, 45 }, // used when 3 seconds deducted off ATA, averages at 40
};
```

In the following discussion, these parameters are used further.

Natural Feature Hit Rate (NFHR) for band set 'A'=133.49276

Feature Hit Rate Time (FHRT)=NFHR×ATA=800.95 seconds

Additional Time Added (ATA)=6 seconds

Additional Time Added Cap limit (ATA_CAP)=60 seconds

The following formula was used to determine the BM when the GTA is modified by capping. This value for BM was then used for the target average value when determining the random range for BM. The BM for each user is dependant upon their Game Time Average (GTA). The BM also incorporates the number of pay-lines. However, for the purpose of this game the pay-lines are fixed at 20.

$$BM(n) = \frac{\text{PAY_Lines}(n) \times FHRT}{GTA(n) \times NFHR} \times \text{SCALING} = \frac{\text{PAY_LINES}(n) \times ATA}{GTA(n)}$$

where,

'n'—individual user id.

GTA(n)—individual user Game Time Average. (i.e. 3.3 seconds)

PAY_LINES(n)—number active pay-lines for the individual user. (i.e. 20)

NFHR—Natural Feature Hit Rate, constant based upon the reel bands. (133.49275)

FHRT—Feature Hit Rate Time, average target constant. (NFHR×ATA)

SCALING—Universal scaling constant (defined as 1 by setting FHRT=NFHR×ATA=801 seconds).

$$\text{SCALING} = \frac{ATA \times NFHR}{FHRT} = 1 \text{ for the embodiment being described}$$

where,

ATA—Additional Time Added. (i.e. 6 seconds)

Following every new game when BM is calculated, if BM has a fractional part BM is either rounded up or down based upon a chance decision determined by the fractional component. Therefore, if BM=1.6 there is a 60% chance that BM will be rounded up to 2. However, the parameters of the embodiment being described cannot result in such fractional results.

A mechanism employed that allows the embodiment being described to achieve its objectives is dynamic reel band switching, which utilises 2 reel band sets A and B. Band set A contains a community feature entry possibility, whereas band set B has no community feature entry possibility; i.e. when band A is being used there is no possibility of a community feature being triggered whereas when band B is being used it is possible. Each user has their own Feature Band Set Chance (FBSC) which governs how often band set A is selected, and so how often the individual user contributes to activating the community feature. Therefore, when an individual user is playing at a much faster pace, they would normally increase their contribution to the community feature entry rate within a given average time. However, by adjusting the individual users FBSC, their contribution to the community feature entry rate can be kept constant, with their extra contribution being reflected in their increased BM instead.

$$FBSC(N) = \frac{GTA(n) \times NFHR}{\text{PLAYERS} \times FHRT} = \frac{GTA(n)}{\text{PLAYERS} \times ATA}$$

where,

USERS—total number of eligible users in the community (i.e. those that have managed to set his/her eligibility flag.

Thus, in summary of the above it can be seen that the following parameters apply to the community feature:

Eligibility to the community feature bonus is governed by an 'Eligibility Timer', which is graphically depicted as a robber being chased by a cop. The Eligibility Timer typically accumulates 6 seconds per game up to a maximum of 66 seconds. The user becomes eligible when more than 6 seconds have been accumulated, which is typically on the second spin. The user remains eligible until the timer expires at zero seconds.

Community feature bonus activated by a chance event of 3, 4, or 5, scatter predetermined feature entry symbols are displayed, which simultaneously delivers a community feature to all eligible users.

Community 'Bonus Multiplier' increases from ×1 to ×20 in proportion to the Eligibility Timer, over this same region the theoretical (Return To Player) RTP from the community feature ranges from 1.2% to 24.13%

Community 'Bonus Multiplier' further increases from ×20 to ×45 in response to the Eligibility Timer being capped at around 66 seconds, due to fast game play of 3 to 5 seconds per game, the theoretical RTP from the community in this region is 24.13%.

Community stake meter records the user's stake while playing, and is used to determine awards from the community feature, in conjunction with the bonus multiplier.

Minimum average speed of play, while remaining eligible for community feature is 6 seconds per game.

Maximum speed of play is 3 seconds per game.

Maximum theoretical RTP from community feature 24.13%

Basic game and community game combined maximum theoretical RTP 95.00%.

To exemplify the above equations, if there is a single user playing at a speed where his GTA=6, his FBSC will compute to 1.0, which will result in a feature chance of 1 in 133.49275 games (NFHR).

Since the user average game speed is 6 seconds per game, the feature will occur on average every 800.95 seconds (133.49275×6)

If this single user plays at a faster rate where GTA=3, his FBSC will compute to 0.5, which will result in a feature chance of 1 in (2×133.49275) games.

Since the user average game speed is now 3 seconds per game, the feature will still occur on average every 800.95 seconds (2×133.49275×3). As such, it will be seen that although time of each game varies an award is still made such that the resultant long term average is a predetermined time period; in this embodiment 800.95 seconds.

This result shows that playing faster does not cause the feature to be triggered any sooner. However, the efforts of the user in playing at 3 seconds per game have resulted in him staking twice as many games before a feature occurs. To ensure the users feature RTP does not drop due to faster game play, the BM in this example would be doubled.

When more users join the community the FBSC is adjusted to take account of this, such that the community feature trigger rate still remains constant at 800.95 seconds.

Therefore, 2 users playing at GTA=6, produces an FBSC=0.5, which can be added together to give 1.0

However, when 1 user has a GTA=6, and another user has a GTA=3, there respective FBSC is 0.5 and 0.25. However, you need to add 0.25 twice since this chance is occurring twice as often as the 0.5 chance, since this user is playing twice as fast, hence 0.5+(0.25×2)=1

From my above explanation it can be seen that there is a constant average rate at which the community feature occurs of every 800.95 seconds.

For each game played the FBSC and BM for that game are a function of GTA, and in the case of FBSC also the number of users. In the real game GTA is always equal to 6, unless ET is capped.

Therefore;

GTA=ATA−capped seconds from ET, where ATA=6

If it is assumed that the user plays at various speeds of play, and as a consequence his/her Eligibility Timer (ET) increases and decreases (represented by the robber moving to the left and right), but never attempts to push ET beyond its limit so never causes ET to be capped, the user will have a Game Time Average of exactly 6 seconds when his ET finally expires. In conclusion if the user was actual playing at a rate of 3 seconds per game so producing a GTA of 3 seconds (assuming that capping did not occur) then GTA of twice this figure is used to allow for the future benefit the user would incur when he stops playing while ET takes time to expire. When the user stops playing he remains eligible for any community features while his ET has not expired.

When ET is capped there are momentary changes to GTA, which adjust FBSC and BM for the duration of that game, which balances everything out so there is no loss or gain in RTP.

The community feature which is accessed when the predetermined feature entry symbols are displayed may any number of suitable games. However, in one embodiment the following is provided.

The user is presented with a large safe on screen. The safe is blown and a single multiplier win is displayed.

Figure 5:
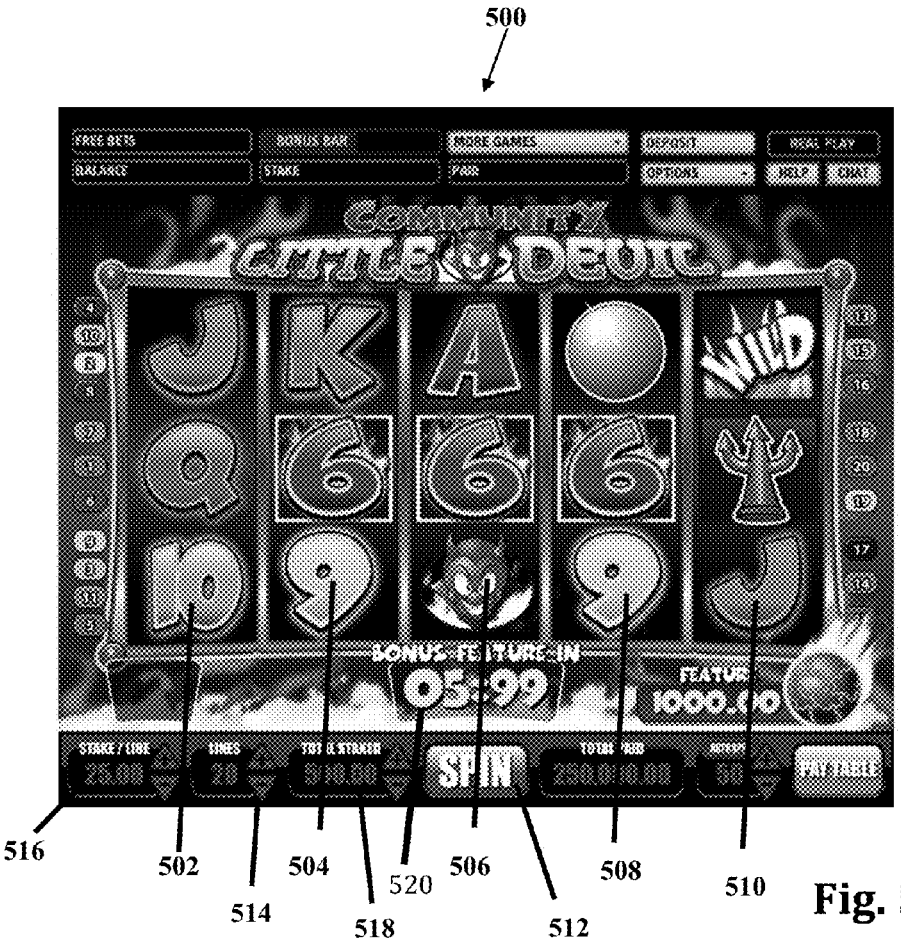
FIG. 5 shows an example screen shot from a second embodiment of the invention.
Figure 6:
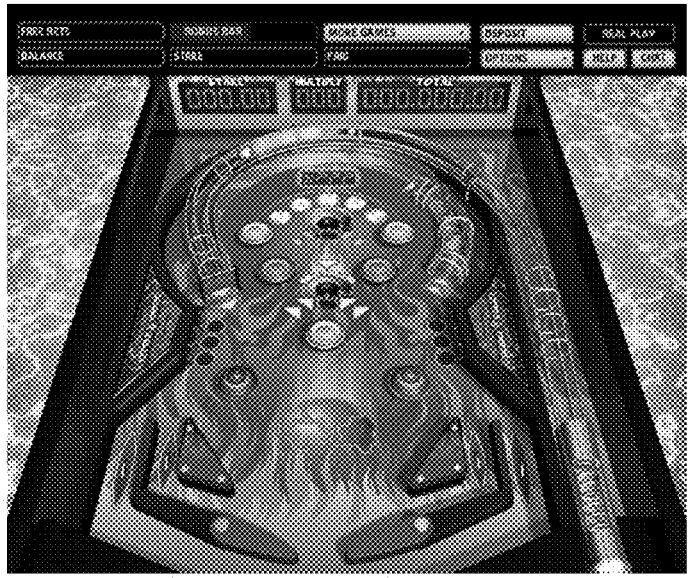
FIG. 6 shows an example screen of a award scheme arranged to distribute a community award.

A second embodiment of a CAD game is shown in FIG. 5 which shows a display 500 in which the user is presented with a display comprising five virtual reels 502, 504, 506, 508, 510. Like parts with the first embodiment are referred to with the same reference numbers.

The terminal 106-116 is arranged such than an activation portion of an input mechanism thereon causes the reels 502-510 to perform a simulated spin and adopt an arrangement which is likely to be different from the arrangement displayed before the user activates activation portion of the input mechanism. In the embodiment being described the new arrangement of the reels 106-116 is entirely random but in other embodiments this need not be the case.

The input mechanism could be any suitable mechanism on the device providing the terminal. The input mechanism may for example be a button on a keyboard; a button on a game controller, a button on a remote control, a soft (or simulated button) on the Graphical User Interface (GUI) of the terminal, a mouse button or the like. In the embodiment being described, the activation portion of the input mechanism comprises a virtual button 512 (labelled 'spin') which a user is arranged to activate using the GUI.

Thus, when a user presses the activation portion of the input mechanism 512 the terminal 106-116 is arranged to send a network communication to the server 104 indicating that the input mechanism 512 has been activated. In response, the server 104 generates the positions that the virtual reels 502-510 should be moved to and sends a network communication to the terminal 106-116 which subsequently displays the new position.

It can be seen that a user of a terminal 106-116 can make a stake for each game (i.e. spin of the reels 106-116) that he/she makes and a further portion of the input mechanism allows a user to adjust the stake. As is common with reel based games, it is also possible to the player to vary the number of lines over which he/she plays at any one time and in the embodiment being described the display 500 provides a virtual button 514 that allows a player to vary the number of lines which is again a portion of the input mechanism. A virtual button 516 is also provided which allows a player to vary the stake per line that is being made. As such, the current stake that is being made, per spin of the reels 502-510, is the product of the number of lines and the stake per line and is displayed on the display 500 at 518.

The game provided by the terminal 106-116 plays as a user might expect a reel based game to play with prizes being award for predetermined combinations of symbols across the virtual reels 502-510. Prizes won by the player accumulate in a prize pot.

Additionally, some symbols displayed on the virtual reels 502-510 cause a community award to be increased. The system is arranged to distribute the community award across the community of users of the system 100.

In the embodiment being described, the community award in increased every time a predetermined symbol appears on the virtual reels 502-510 (which may be thought of as a feature pot symbol). Some embodiments may require that the feature pot symbol appears within predetermined locations on the virtual reels 502-510. For example the feature pot symbol may be required to appear within the central three lines of the virtual reels 502-510.

In the embodiment being described, the feature pot symbol may cause an amount equivalent to the user of terminals stake for that game to be added to the community award (which is given by the product shown at 518). The skilled person will appreciate that the money accumulated by the feature pot symbol is not the players winnings, it is only an amount to be used by the award scheme.

As a player plays the game provided on his/her terminal 106-116 a set of symbols may be displayed on the virtual set of reels 502-510 which causes a community feature game to be triggered (trigger feature symbols). Thus, these trigger feature symbols that cause the community feature game to be triggered may be thought of a trigger point which exists within the trigger mechanism that causes the award scheme to distribute the community award that has accumulated. FIG. 4 shows a display of a community feature game of the embodiment being described.

In the embodiment being described, the user of a terminal 106-116 that causes the trigger point to occur is awarded a bonus. The bonus for example may comprise a multiple of the amount staked for that game (i.e. the product shown at 518).

It will be appreciated that, because the virtual reels 502-510 take truly random positions, then as the number of players in the community that are using the system 100 increases the likelihood of the award scheme being triggered increases. As such, the system is arranged such a delay is introduced between a terminal displaying a set of symbols that provides the trigger point and the award scheme being started which helps to ensure that as the number of players increases the award scheme is not triggered too frequently. In the embodiment being described, the number of players does not affect the RTP (Return To Player). Thus, the timer may be thought of as a portion of the trigger mechanism which provides a delay such that it typically takes more than a predetermined amount of time to trigger the award scheme.

In the embodiment being described the delay is provided by a timer 320, which counts down from 7 minutes and 6 seconds and when the timer reaches zero, the award scheme is started. The skilled person will appreciate that the timer may count up rather than down and that any other time may be suitable. The actual time chosen may depend on a number of features including the number of players using the system; the length of time that the award scheme takes to operate, or the like.

In the embodiment being described should the trigger symbols appear whilst the timer 520 is running then the associated bonus described above is still awarded to the user of the terminal but the timer is not restarted. This could of course be different in other embodiments.

Also, the game played on the terminals allows users of the terminal 106-116 to become eligible to receive a portion of the award from the award scheme. In the embodiment being described, predetermined symbols appearing on the virtual reels 502-510 cause the user of that terminal to become eligible (i.e. the trigger feature symbols). The predetermined symbols may occur before the timer 520 starts and/or the timer 520 starts and as such, users of the system may become eligible at any time regardless of whether the timer 520 is running.

In other embodiments, different mechanisms may determine which users of the terminals become eligible for a portion of the community award via the award scheme. For example, it may be that all players of the system are eligible; a random, pseudo random, or otherwise selection of the players may be eligible, or the like.

In the embodiment being described, the award scheme comprises a pin ball game and as such, the award scheme may be recognised by a person skilled in the art as being a feature game. Thus, the user of the terminal 106-116 that triggered the award scheme plays the feature and accumulates points. When the feature game is over the award that has been accumulated is distributed across all of the users that are eligible by virtue of their collection of the trigger symbols according to the contribution of the community award by that user (i.e. according to the award collected by the feature pot symbols).

Thus, at least some of the embodiments of the invention are arranged such that timer is triggered (a predetermined trigger point occurs) as a chance event; i.e. the occurrence of the trigger symbols.

The skilled person will again appreciate that other mechanisms may be used to distribute the award between users of the terminals. For example, each eligible user may receive the same amount; users may receive an award according to the amount spent rather than the amount contributed to the community award; or the like.

During the award scheme, which in this embodiment, a user may collect multipliers as the pinball moves around the pinball table. Once the award scheme has finished the amount won from the award scheme may be calculated by the value of the feature pot multiplied by the total value of the multiplier collected by the ball during the award scheme. In the embodiment being described the possible multipliers that a user is able to collect may fall in the range ×10 to ×500.

In the embodiment being described, the award scheme terminates when the ball of the pinball games leaves the table. However, in other embodiments, the award scheme may terminate after a predetermined time or the award scheme may simply be a random event determined automatically, typically by the server, or the like.

In some embodiments, if a user has money in the feature pot and leaves the game, then if a feature is triggered in the users absence, that user should be awarded a portion of the community award. The system may be arranged to inform such a user of his/her winnings the next time they log into the system.

Some embodiments of the invention may also provide different versions of the award scheme where the version provided determines the chance of a user winning and/or the amount that a user can win. In the embodiment being described, this may be thought of as providing Small win table.

Medium win table.

Big win table.

In one embodiment these tables may be arranged such that the chances of a user winning may be given as follows:

Small win—73.4%

Medium win—20.7%

Big win—5.9%

Figure 2:
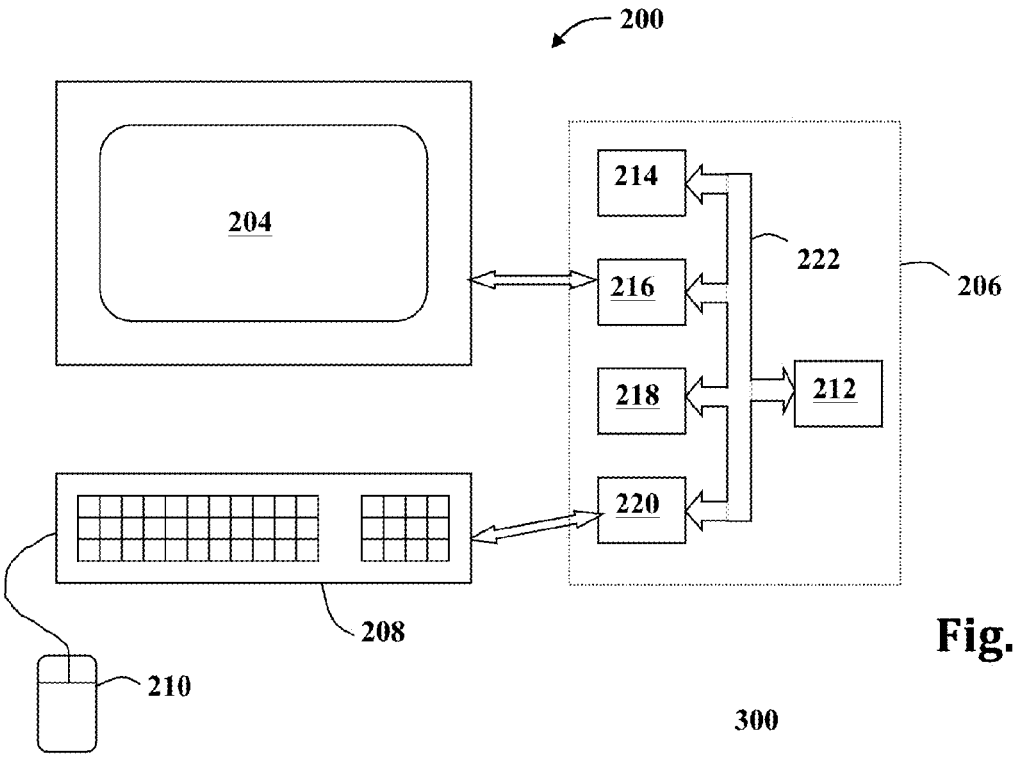
FIG. 2 exemplifies a typical system suitable for providing at least aspects of the network described with reference to FIG. 1.
Figure 7:
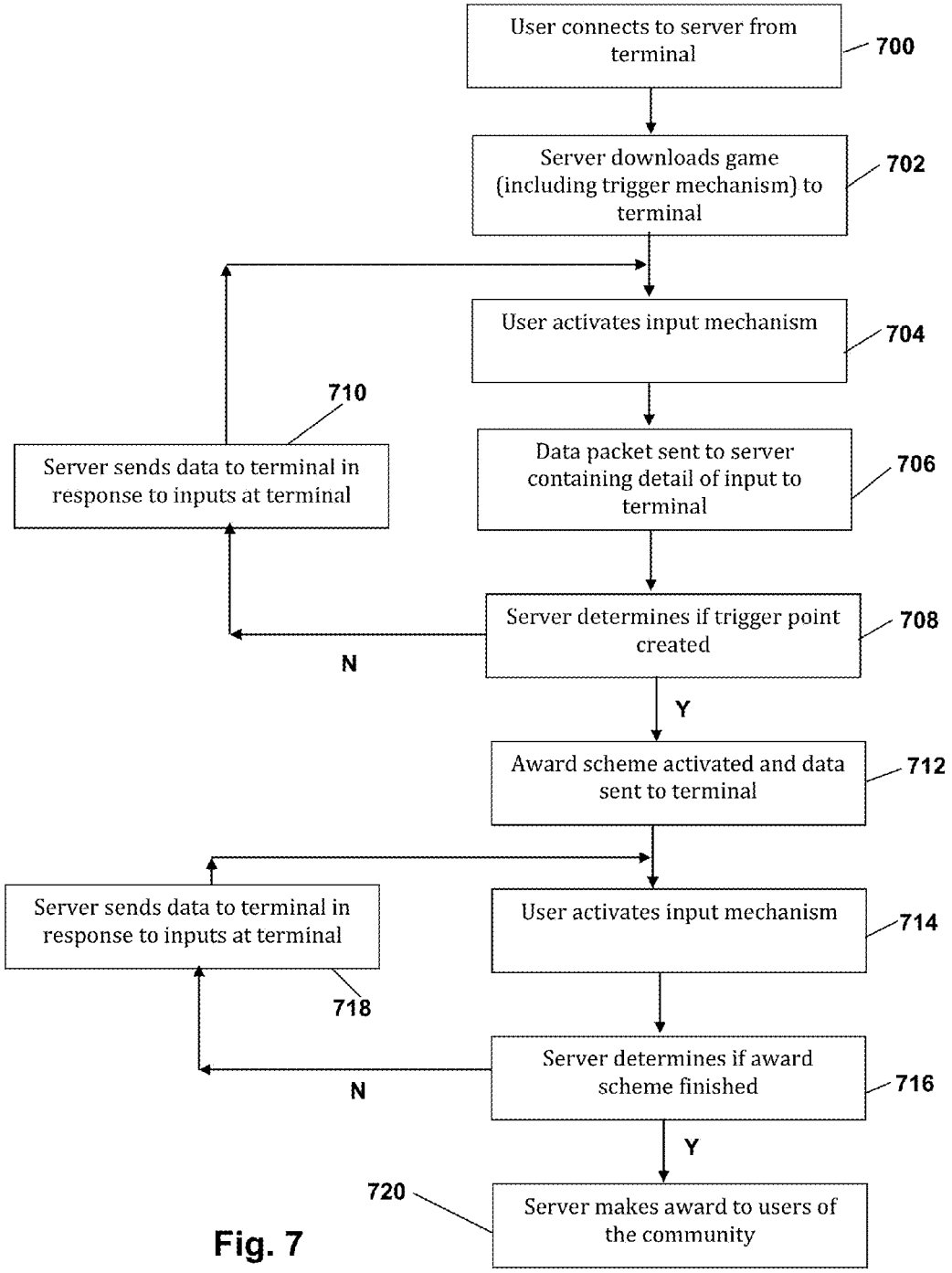
FIG. 7 shows a flow chart of how the embodiment described in relation to FIG. 5 functions.

Thus, to describe the functionality of the embodiment described in relation to FIGS. 1, 2 and 5 reference is made to FIG. 7.

In step 700 a user of a terminal 106-116 joins the community and connects to the server 104. In response 702 to this connection, the server 104 downloads a client software to the terminal 106-116, which in this embodiment, is a Flash game which includes a trigger mechanism. Thus, a user of the terminal may be thought of as being a player of the game provided on the terminal.

The user of the terminal 106-116 then uses (i.e. plays) the client software and activates the input mechanism on the terminal (step 704). Data containing the inputs made via the input mechanisms made to the terminal is sent back to the server (step 706). This data sent to the server 104 will include whether the user has activated the activation portion of the input mechanism 512; how much is staked; the number of lines being played; etc.

On receipt of the data, the server 104 determines whether the game running on that terminal has caused a trigger point in step 708. If not then the server 104 generates data allowing the client software on the terminal to determine the new display and transmits that to the terminal 106-116 in step 710.

If the server determines that the trigger mechanism running on that terminal 106-116 has generated a trigger point (e.g. the trigger symbols have been displayed) and assuming that no other terminals have already triggered the start of the award scheme, a timer 520 (i.e. a delay mechanism) is started and data is downloaded to the terminal 106-116 (step 712).

Once the timer 520 has expired then the data being sent to the terminal changes to that of the award scheme. A user can then use the input mechanism of his/her terminal in order to interact with the award scheme step 714.

The award scheme continues until it is terminated (e.g. the user lets the ball fall from the pinball table) and a determination of this is made in step 716. However, until this happens the server 104 continues to send updated data to the terminals (step 718) in order that the terminal can display the award scheme.

Once the award scheme has terminated the server 104 is arranged to distribute the community award across the eligible users of the community in step 720.

In other embodiments the delay provided by the trigger mechanism may be provided by a mechanism other than a set of reels and a timer. In one such embodiment, the terminals 106-116 are arranged to provide a trail based game rather than a set of virtual reels. The skilled person will appreciate that, in a trail based game, a user moves around a so-called trail (i.e. a path) and in one embodiment would need to move completely around the trail at which point he/she activate the award scheme; i.e. reaching the end of the trail (or at least a predetermined point on the trail) provides the trigger point. In the first embodiment described above, the trigger mechanism comprises a timer and/or the sets of reels.

Such a trail provides an inherent delay since it takes time for a user to move around the trail. Typically, a random mechanism (which could be virtual reels, a dice or simulation thereof), provides an event which is used to determine what proportion of the trail a user moves along the trail in any one round of play (this may for example be how many spaces within the trail a user moves should be trail be created from discrete portions; i.e. spaces). It may be that a user does not move around the trail on each round and requires a predetermined symbol to be generated or other even to occur. Such embodiments would typically be arranged such the odds of obtaining a symbol (or other event) to cause movement around the trail are relatively low such that, on average, it will take a user a time (perhaps a significant time) to move around the trail and activate the trigger point.

Whilst some embodiments of the invention relate to the distribution of awards from playing games, the distribution system may equally be arranged to distribute other, more tangible, assets. Embodiments of the system may be arranged to distribute any assets across a community where it is desirable that an award should be distributed so that it does not adversely affect the party making the distribution; for example by giving away too much asset, by distributing the asset too frequently; or the like.

Generally the random mechanism is truly random but this need not be the case and it may be pseudo random or operate according to a pre-determined algorithm.

The skilled person will appreciate that aspects of the embodiments described herein may be provided in software. Those same features may also be provided in hardware or firmware or in a combination of software, firmware and hardware.

The server may comprise a timer arranged to monitor time and ensure that the long term resultant average time between such awards corresponds to the predetermined time period.

Any reference to player may be interpreted as referring to a user and visa versa.

What is claimed is:

1. A server arranged to be connected to a plurality of terminals and provide a community award distribution system which is arranged to distribute, between at least some of the terminals connected thereto, an award which has been contributed to by at least some of a plurality of terminals connected thereto, the server comprising:

a processor; and a machine readable medium containing instructions which when read by the processor cause that server to:

a) receive a request from a terminal that the terminal should connect to the server for the provision of the community award distribution system;

b) download data to the terminal wishing to connect to the server for the provision of the community award distribution system, the data providing a trigger mechanism which includes a trigger point which causes the start of an award scheme and a delay between the trigger point and the start of the award scheme, such that there is typically more than a predetermined amount of time between occurrences of the award scheme;

c) receive data from a terminal indicating inputs made to the trigger mechanism via an input mechanism of a terminal, the trigger mechanism provides a reel based game including more than one reel set;

d) process the data received from a terminal and determine whether the trigger mechanism on that terminal has caused the trigger point to be reached;

e) once the trigger point is determined to have been reached, determine whether an award scheme should be started;

f) determine the completion of the award scheme and subsequently determine the award to be made to one or more terminals connected thereto using the formula:

$$\text{award}=\text{CMA}\times\text{CS}\times\text{BM}$$

where CMA is a Community Multiplier Award, CD is a Community Stake, and BM is a Bonus Multiplier;

the Bonus Multiplier for a particular user n is defined by the formula:

$$BM(n) = \frac{\text{PAY_LINES}(n)}{GTA(n)}$$

where, n identifies the particular user;

PAY_LINES(n) is the number of pay lines for the particular user;

GTA(n) is the game time average for the particular user; and g) communicate the award to any terminal that has received an award.

2. A server according to claim 1 in which the trigger mechanism comprises a virtual reel based game which is downloaded to terminal device connected to the server.

3. A server according to claim 1 in which the delay is provided by a timer which is started once the trigger point within the trigger mechanism has been reached.

4. A server according to claim 3 which determines, in step e, that the award scheme should be started when the timer reaches a predetermined value.

5. A server according to claim 1 which is arranged to accumulate an award contributed by the trigger mechanisms provided on terminals and connected thereto.

6. A server according to claim 5 in which the server is arranged to distribute the accumulated award to terminals which are deemed eligible for a portion of the accumulated award.

7. A server according to claim 1 in which in which, in step d, the server is also arranged to make a determination as to whether the terminal from which the data has been received has become eligible for a portion of the award to be distributed.

8. A server according to claim 1 which is arranged to provide a feature game as the award scheme.

9. A server according to claim 8 in which the server is arranged to allow a player to accumulate multipliers via the feature game that, at least in part, determine the award to be distributed.

10. A community award distribution system arranged to distribute an award between a plurality of users, wherein the system comprises at least one server and a plurality of terminals arranged to be in communication with the at least one server across a network connection between the server and each terminal;

each terminal provides a reel based game including reel sets;

wherein the server is arranged to provide an award scheme that is arranged to distribute an award between at least some of the terminals in communication therewith, wherein the award has been contributed to by at least some of the terminals and wherein each of the terminals is arranged to provide a reel based trigger mechanism to determine when the award scheme is triggered; and wherein the system is arranged such that the terminals are arranged to provide users thereof with the trigger mechanism and generate a communication between the server/terminal across the network connection when a predetermined trigger point is generated by the trigger mechanism which determines the award scheme should be initiated;

the trigger mechanism being arranged such that it provides a trigger point which causes the start of an award scheme and a delay between the trigger point and the start of the award scheme, such that there is typically more than a predetermined amount of time between occurrences of the award scheme;

the award scheme being determined by the following formula:

$$award = CMA \times CS \times BM$$

where CMA is a Community Multiplier Award, CD is a Community Stake, and BM is a Bonus Multiplier, the Bonus Multiplier for a particular user n is defined by the formula:

$$BM(n) = \frac{PAY_LINES(n)}{GTA(n)}$$

where, n identifies the particular user;

PAY_LINES(n) is the number of pay lines for the particular user;

GTA(n) is the game time average for the particular user; and the server then being arranged to execute the award scheme and distribute the award between the at least some terminals and communicate the award to those terminals across the network connection.

11. A system according to claim 10 in which the server and terminals are arranged to operate as thin client in which the server is arranged to determine what the trigger mechanism displays.

12. A method of distributing an award amongst a community of users of a system, the system comprising a server connected to a plurality of terminals over a network, the award having been contributed to by each of the users of the system, the method comprising:

providing terminals having reel sets and symbols displayed on the reel sets;

at the server, receiving a request from a terminal that the terminal should connect to the server for the provision of the community award distribution system;

at the server, downloading data to the terminal wishing to connect to the server for the provision of the community award distribution system, the data providing a trigger mechanism which when activated:

allows a user to generate a trigger point by spinning the reel sets which causes the start of an award scheme; and provides a delay between the trigger point and the start of the award scheme, such that there is typically more than a predetermined amount of time between occurrences of the award scheme;

at the server, receiving data from a terminal indicating inputs made to the trigger mechanism via an input mechanism of a terminal;

at the server, processing the data received from a terminal and determining whether the trigger mechanism on that terminal has caused the trigger point to be reached;

once the trigger point is determined to have been reached, determining, at the server whether an award scheme should be started;

at the server, determining the completion of the award scheme and subsequently determining the award to be made to one or more terminals connected thereto with the formula:

$$award = CMA \times CS \times BM$$

where CMA is a Community Multiplier Award, CD is a Community Stake, and BM is a Bonus Multiplier;

the Bonus Multiplier for a particular user n is defined by the formula:

$$BM(n) = \frac{PAY_LINES(n)}{GTA(n)}$$

where, n identifies the particular user;

PAY_LINES(n) is the number of pay lines for the particular user;

GTA(n) is the game time average for the particular user; and at the server, communicating the award to at least some of the terminals connected to the server.

13. A non-transitory machine readable medium containing instructions which when loaded onto a machine cause that machine to:

receive a request from a terminal having a reel sets including symbols, the terminal being connected to the machine for the provision of the community award distribution system;

download data to the terminal wishing to connect to the machine for the provision of the community award distribution system, the data providing a trigger mechanism which when activated:

allows a user to generate a trigger point by spinning the reel sets which causes the start of an award scheme; and provides a delay between the trigger point and the start of the award scheme, such that there is typically more than a predetermined amount of time between occurrences of the award scheme;

receive data from a terminal indicating inputs made to the trigger mechanism via an input mechanism of a terminal;

process the data received from a terminal and determine whether the trigger mechanism on that terminal has caused the trigger point to be reached;

once the trigger point is determined to have been reached, determine whether an award scheme should be started;

determine the completion of the award scheme with the formula:

$$\text{award}=\text{CMA}\times\text{CS}\times\text{BM}$$

where CMA is a Community Multiplier Award, CD is a Community Stake, and BM is a Bonus Multiplier, and subsequently determine the award to be made to one or more terminals connected thereto;

the Bonus Multiplier for a particular user n is defined by the formula:

$$BM(n) = \frac{\text{PAY_LINES}(n)}{GTA(n)}$$

where, n identifies the particular user;

PAY_LINES(n) is the number of pay lines for the particular user;

GTA(n) is the game time average for the particular user; and communicate the award to any terminal that has received an award.

14. A server according to claim 1, wherein the duration of the delay is dependent on the number of terminals connected to the server.

15. A server according to claim 1, wherein the server is arranged to, after the trigger point has been reached and before the start of the award scheme:

receive data from a terminal including a trigger mechanism including reel sets that spin, the data dictates further inputs made to the trigger mechanism via an input mechanism of a terminal;

process the data received from a terminal and determine whether the trigger mechanism on that terminal has caused the trigger point to be reached again; and provide a bonus award to the terminal if the trigger point has been reached again.

16. A server according to claim 15, wherein the server is arranged such that the timer does not restart if the trigger point is reached again.

17. A server according to claim 7, wherein the server is arranged to, after the trigger point has been reached and before the start of the award scheme:

receive data from a terminal indicating further inputs made to the trigger mechanism via an input mechanism of a terminal;

process the data received from a terminal and determine whether the terminal from which the data has been received has become eligible for a portion of the award to be distributed.

18. A server according to claim 8, wherein the server is arranged to:

provide the feature fame only to terminal which first caused the trigger point to be reached; and upon completion of the feature game, to distribute the accumulated award to terminals which are deemed eligible for a portion of the accumulated award.

19. A server according to claim 1, wherein the BM is multiplied by a variable called SCALING, which results from community feature play and is defined by the formula:

SCALING=NFHR/FHRT wherein, NFHR is Natural Feature Hit Rate and FHRT is Feature Hit Rate Time.

* * * * *